US009539627B2

(12) United States Patent
Frobose

(10) Patent No.: US 9,539,627 B2
(45) Date of Patent: Jan. 10, 2017

(54) PILGER ROLLING MILL WITH A CRANK DRIVE

(71) Applicant: SANDVIK MATERIALS TECHNOLOGY DEUTSCHLAND GMBH, Dusseldorf (DE)

(72) Inventor: Thomas Frobose, Versmold (DE)

(73) Assignee: SANDVIK MATERIALS TECHNOLOGY DEUTSCHLAND GMBH, Dusseldorf (DE)

( * ) Notice: Subject to any disclaimer, the term of this patent is extended or adjusted under 35 U.S.C. 154(b) by 0 days.

(21) Appl. No.: 14/652,613

(22) PCT Filed: Dec. 16, 2013

(86) PCT No.: PCT/EP2013/076738
§ 371 (c)(1),
(2) Date: Jun. 16, 2015

(87) PCT Pub. No.: WO2014/095746
PCT Pub. Date: Jun. 26, 2014

(65) Prior Publication Data

US 2015/0343505 A1 Dec. 3, 2015

(30) Foreign Application Priority Data

Dec. 17, 2012 (DE) ..... 10 2012 112 398

(51) Int. Cl.
*B21B 21/00* (2006.01)
*B21B 21/02* (2006.01)
*B21B 35/14* (2006.01)
*B21B 35/06* (2006.01)

(52) U.S. Cl.
CPC ..... *B21B 21/005* (2013.01); *B21B 21/02* (2013.01); *B21B 35/14* (2013.01); *B21B 35/06* (2013.01); *B21B 2203/20* (2013.01)

(58) Field of Classification Search
CPC ..... B21B 21/005; B21B 21/02; B21B 35/06; B21B 35/14; B21B 2203/20
See application file for complete search history.

(56) References Cited

U.S. PATENT DOCUMENTS

| | | | |
|---|---|---|---|
| 3,584,489 | A | 6/1971 | Peytavin |
| 5,224,369 | A | 7/1993 | Rehag et al. |
| 2004/0045334 | A1 | 3/2004 | Baensch |

*Primary Examiner* — Teresa M Ekiert
(74) *Attorney, Agent, or Firm* — Corinne R. Gorski

(57) ABSTRACT

A pilger rolling mill with a roll stand moves linearly back and forth along a movement direction and includes a crank mechanism having a rotatably supported crankshaft with a crank pin and push rod. A first end of the push rod is pivotably fastened to the crank pin and a second end is pivotably fastened to the roll stand, so that during operation of the pilger rolling mill a rotary movement of the crankshaft is converted into an oscillating movement of the roll stand along the movement direction. A compensation shaft is rotatably supported about an axis of rotation and includes a distribution of mass that is not rotationally symmetrical relative to its axis of rotation and a counter-mass. The crankshaft and the compensation shaft are connected to one another by a transmission so that a rotation of the crankshaft leads to a rotation of the compensation shaft.

10 Claims, 2 Drawing Sheets

PILGER ROLLING MILL WITH A CRANK DRIVE

RELATED APPLICATION DATA

This application is a §371 National Stage Application of PCT International Application No. PCT/EP2013/076738 filed Dec. 16, 2013 claiming priority of DE Application No. 102012112398.5, filed Dec. 17, 2012.

The present invention relates to a pilger rolling mill with a roll stand that can move linearly back and forth along a movement direction and with a crank drive, whereby the crank drive comprises a crankshaft that is rotatably supported about an axis of rotation and that comprises a crank pin at a radial distance from the axis of rotation, and comprises a connecting rod with a first and a second end, whereby the first end of the connecting rod is pivotably fastened to the crank pin, and whereby the second end of the connecting rod is pivotably fastened to the roll stand, so that during the operation of the pilger rolling mill a rotary movement of the crankshaft is converted into an oscillating movement of the roll stand along the movement direction, and with a compensation shaft that is rotatably supported about an axis of rotation, whereby the compensation shaft comprises a distribution of mass that is not rotationally symmetrical relative to its axis of rotation and has a counter-mass, whereby the crankshaft and the compensation shaft are connected to one another by a transmission so that a rotation of the crankshaft leads to a rotation of the compensation shaft.

In order to manufacture precise metallic tubes, in particular consisting of stainless steel, an extended, hollow cylindrical blank is reduced by pressure stresses, during which the blank is deformed to a tube with a defined outside diameter and a defined wall thickness.

The most widespread reducing method for tubes is known as cold pilger rolling whereby the blank is called a tube shell. The tube shell is pushed in the completely cold state during the rolling over a calibrated, i.e., having the inside diameter of the finished tube, rolling mandrel and is surrounded from the outside by two rolls that are calibrated, i.e., that define the outside diameter of the finished tube, and is rolled out in the longitudinal direction over the rolling mandrel.

During the cold pilger rolling the tube shell experiences a step-by-step advance in the direction towards the rolling mandrel or beyond the same while the rolls are moved horizontally back and forth in a rotating manner over the rolling mandrel and therefore over the tube shell. At this time the horizontal movement of the rolls is set by a roll stand on which the rolls are rotatably supported. The rolls for their part receive their rotary movement from a toothed rack that is stationary relative to the roll stand, into which gears engage that are permanently connected to the roll shafts. The advance of the tube shell over the rolling mandrel takes place with the aid of a feed clamping saddle that makes possible a transitory movement in a direction parallel to the axis of the rolling mandrel. The linear advance of the feed clamping saddle in the known cold pilger rolling mill is achieved with the aid of a ball screw or with the aid of a linear drive.

The conically calibrated rolls arranged superposed in the roll stand rotate counter to the direction of advance of the feed clamping saddle. The so-called pilger mouth formed by the rolls grasps the tube shell and the rolls press a small material wave away from the outside that is extended by the smoothing caliber of the rolls and the rolling mandrel to the intended wall thickness until the clearance caliber of the rolls frees the finished tube.

During the rolling the roll stand moves with the rolls fastened to it counter to the direction of advance of the tube shell. With the aid of the feed clamping saddle the tube shell is advanced after having reached the clearance caliber of the rolls by another step toward the rolling mandrel while the rolls with the roll stand return into their horizontal starting position. At the same time the tube shell experiences a rotation about its axis in order to achieve a uniform shape of the finished tube in the circumferential direction. A uniform wall thickness and roundness of the tube as well as uniform inside- and outside diameters are achieved by a multiple rolling over each tube section.

The horizontal back and forth motion of the roll stand is achieved with the aid of a crank drive. The crank drive consists of a crankshaft that can rotate about an axis of rotation and which comprises a crank pin at a distance from the axis of rotation, and of a connecting rod with a first and a second end. The connecting rod is pivotably articulated at its first end to the crank pin of the crankshaft and is pivotably articulated at its second end to the roll stand so that a rotary movement of the crankshaft is converted into a translatory movement of the roll stand. The direction of movement of the roll stand is fixed by guide rails.

In order to manufacture precisely manufactured tubes a precise and controlled, step-by-step advance of the feed clamping saddle as well as a precise and controlled translatory movement of the roll stand is indispensable. In particular, the conversion of a large torque into a linear force in the direction of translation of the roll stand is subjected to high demands.

In order to make possible a uniform course of the oscillating movement of the roll stand and thus make a high quality of the rolled-out tube available, it is therefore necessary to make a drive available for the linear movement of the roll stand that has substantially no free forces or free moments or in which the free forces or free moments are minimized.

At least one of these problems is solved in accordance with the invention by a pilger rolling mill with a roll stand that can move linearly back and forth along a movement direction and with a crank drive, whereby the crank drive comprises a crankshaft that is rotatably supported about an axis of rotation and that comprises a crank pin at a radial distance from the axis of rotation, and comprises a connecting rod with a first and a second end, whereby the first end of the connecting rod is pivotably fastened to the crank pin, and whereby the second end of the connecting rod is pivotably fastened to the roll stand, so that during the operation of the pilger rolling mill a rotary movement of the crankshaft is converted into an oscillating movement of the roll stand along the movement direction, and with a compensation shaft that is rotatably supported about an axis of rotation, whereby the compensation shaft comprises a distribution of mass that is not rotationally symmetrical relative to its axis of rotation and has a counter-mass, whereby the crankshaft and the compensation shaft are connected to one another by a transmission so that a rotation of the crankshaft leads to a rotation of the compensation shaft and whereby the axis of rotation of the crankshaft and the axis of rotation of the compensation shaft are spaced apart from one another in a direction vertical to the direction of movement of the roll stand.

In other words, according to the invention the axes of rotation of the crankshaft and of the compensation shaft are arranged superposed above one another. At first, this does not exclude the fact that the axes of rotation also have a distance from one another in a direction parallel to the direction of movement of the linear movement of the roll stand. The invention makes it possible to keep small the dimensions of the arrangement consisting of crank drive and compensation shaft in a direction parallel to the direction of movement of the roll stand.

However, it is especially advantageous if the axis of rotation of the crankshaft and the axis of rotation of the compensation shaft are in a plane vertical to the direction of movement of the roll stand. In this case the axes of rotation are not separated from one another in a direction parallel to the linear direction of movement of the roll stand. With this embodiment the smallest structural length of the arrangement consisting of crank drive and compensation shaft can be achieved.

Such an embodiment of the pilger rolling mill with a crank drive for driving the roll stand and a compensation shaft with a distribution of mass with a counter-mass, which distribution is not rotationally symmetrical relative to its axis of rotation, makes it possible to compensate at least partially the forces and moments occurring during the operation of the pilger rolling mill.

In one embodiment of the invention the connection between crankshaft and compensation shaft is realized via the transmission in such a manner that an entire revolution of the crankshaft results in precisely one entire revolution of the compensation shaft. In this manner the occurring forces and moments of the first order can be at least partially compensated. It is advantageous if the counter-mass is approximately equally as large as the mass of the connecting rod acting on the crankshaft.

In particular, it is advantageous if the crankshaft also has a compensation mass that, like the crank pin, is at a distance from the axis of rotation and is arranged offset from the latter by approximately 180° relative to the axis of rotation.

Crankshaft in the sense of the present application denotes every type of shaft with a crank pin concentrically arranged on it for receiving the connecting rod. In particular, a crankshaft in the sense of the present application includes a conventional construction with rotatably supported shaft journals defining the axis of rotation and with one or more crank cheeks connecting the shaft journals and the crank pins. Furthermore, however, a crankshaft in the sense of the present invention especially denotes a crank wheel that is rotatably supported on a shaft, whereby the crank pin is fastened eccentrically to the axis of rotation on the wheel itself.

Such a construction of the crankshaft as a crank wheel has a number of advantages. It clearly simplifies the mounting and maintenance. In addition, a crankshaft constructed as a crank wheel can be used as an additional flywheel mass ensuring an improved operational smoothness of the roll stand.

If different types of tubes are to be rolled with the same pilger rolling mill, an embodiment is advantageous in which the crank pin can be fastened at different radial distances from the axis of rotation of the crankshaft on the latter, preferably on the crank wheel, so that different stroke lengths of the roll stand can be realized with the same crank drive.

Furthermore, an embodiment is advantageous in which a compensation mass is provided on the crankshaft wherein the compensation mass preferably is fastened on the crankshaft in a replaceable manner so that the mass of the compensation mass can be varied. In addition, an embodiment is preferred in which even the position of the compensation mass can be adjusted relative to its radial distance from the axis of rotation of the crankshaft and/or relative to the angular distance from the crank pin.

It is especially advantageous if the crank wheel has a width in a direction parallel to the axis of rotation whereby a compensation mass is arranged inside the width of the crank wheel.

It is especially advantageous if the compensation mass and the crank pin with the connecting rod are arranged at a distance from each other in the direction of the axis of rotation.

In an embodiment the compensation shaft is constructed as a compensation wheel that has a width in the direction of the axis of rotation of the compensation shaft, whereby the counter-mass is arranged at least in sections outside of the width of the compensation wheel.

Furthermore, an embodiment in which the crankshaft as crank wheel as well as the compensation shaft is constructed as a compensation wheel proves to be advantageous since it makes it possible that the crank wheel and the compensation wheel are toothed wheels that mesh with one another and form the transmission connecting the crankshaft and the compensation shaft to one another. In this manner an additional transmission with other gears that are affected by wear can be eliminated.

In one embodiment of the invention the axis of rotation of the crankshaft is arranged in a direction vertical to the direction of movement of the roll stand underneath the axis of rotation of the compensation shaft. In this manner a flat angle can be achieved between the direction of movement of the roll stand to be driven and the connecting rod, which again results in a quieter running of the roll stand and in addition reduces the wear of the linear guides of the roll stand.

It is especially advantageous if the roll stand comprises two rolls, whereby the rolls fix the central tube axis of a tube to be rolled, whereby the axis of rotation of the crankshaft is arranged underneath the central tube axis and the axis of rotation of the compensation shaft is arranged above the central tube axis.

In this manner a drive unit for the roll stand with crank drive and compensation shaft can be made available that has a short construction length in a direction parallel to the direction of movement of the roll stand but which length on the other hand does not require a deep pit in the machine hall for the pilger rolling mill.

In order to reduce the occurring free forces and moments, it proved to be especially advantageous if the crank drive comprises two crank wheels that can rotate about a common axis of rotation and with crank pins at a radial distance from the axis of rotation and comprises two connecting rods with a first and a second end, whereby the first end of each connecting rod is pivotably fastened to a crank pin and whereby the second end of each connecting rod is pivotably fastened to the roll stand, so that during the operation of the pilger rolling mill a rotary motion of the crankshaft is converted into a linearly oscillating motion of the roll stand along the direction of the motion, and whereby the compensation shaft comprises two compensation wheels that can rotate about the same axis of rotation and which each comprise a compensation mass.

Due to the symmetry of such an arrangement, the free forces and moments, in particular those of the first order are clearly reduced if not completely suppressed. This is especially the case if the arrangement is constructed symmetrically to a plane vertical to the axes of rotation of the crankshaft and of the compensation shaft.

It is also advantageous here if the crank pins with the connecting rods received on them as well as the counter-masses of the compensation wheels extend in a common plane vertical to the axes of rotation.

It is understood that in such a symmetric construction with two crank shafts, all previously described optional features can also be advantageously realized.

In one embodiment the pilger rolling mill comprises a drive motor with a motor shaft, whereby the motor shaft is directly connected to the crankshaft or to the compensation shaft in such a manner that a revolution of the motor shaft results in exactly one revolution of the crankshaft or of the compensation shaft. A direct connection in the sense of the present invention denotes a connection without a transmission. In particular, such a connection can be realized in that the motor shaft is connected to the crankshaft or to the compensation shaft by a coupling, or that the motor shaft and the crankshaft or the compensation shaft are constructed in one piece. In a preferred embodiment the drive motor is a hollow shaft motor that is pushed onto the crankshaft or onto the compensation shaft. Here, the hollow shaft of the motor is advantageously connected to the crankshaft or to the compensation shaft and the motor housing is stationarily fixed so that the hollow shaft motor directly drives the crankshaft or the compensation shaft.

In an embodiment of the invention the drive motor is a so-called torque motor, that as an electric motor makes available a sufficient torque for such a direct drive of the crankshaft or of the compensation shaft.

It is advantageous here if the pilger rolling mill comprises a drive motor that is arranged in such a manner that it drives the compensation shaft and via the compensation shaft the crankshaft. Such a design proved to be especially advantageous in an arrangement in which the crankshaft lies in a direction vertical to the direction of movement of the roll stand underneath the compensation shaft since the motor does then not have to be lowered into a pit in the machine hall. In this manner the motor is free and readily accessible for maintenance work.

Other advantages, features and application possibilities of the present invention become clear using the following description of embodiments and of the associated figures.

In the figures the same elements are designated with the same reference numerals.

FIGS. 1 and 2 show a first embodiment of the pilger rolling mill in accordance with the invention and a drive unit for the roll stand of such a pilger rolling mill in schematic views.

Figure 1:
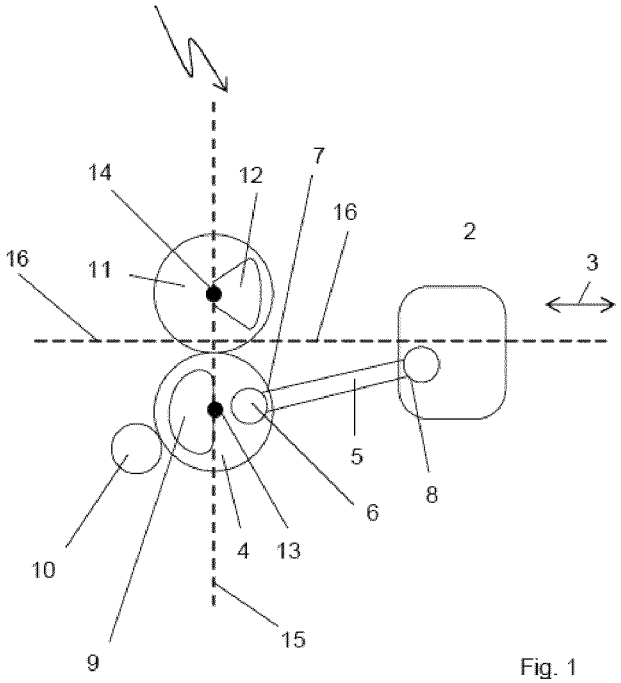
FIG. 1 shows a schematic lateral view of a first embodiment of a pilger rolling mill in accordance with the invention.

A roll stand 2 of the pilger rolling mill 1 is driven in such a manner with the aid of the drive discussed here that it moves back and forth oscillating in a linear manner in a direction of movement 3. In order to generate this linearly oscillating movement of the roll stand 2, a crank drive is used comprising a crankshaft 4 and a connecting rod 5. The crankshaft 4 can rotate about an axis of rotation 13.

The crankshaft 4 consists in the embodiment shown of a crank wheel 4 with a crank pin 6 eccentrically fastened on it on which the connecting rod 5 is pivotably arranged with the aid of a bearing. While the first end 7 of the connecting rod 5 is fixed on the crank wheel or its crank pin 6, the second end 8 of the connecting rod 5 is pivotably fastened on the roll stand 2 with the aid of a bearing. In this manner a rotation of the crank wheel 4 results in a linearly oscillating motion of the roll stand 2 in the direction of movement 3. The crank wheel 4 additionally comprises a non-rotationally symmetric distribution of mass that is made available in that a compensation mass 9 is eccentrically fastened on the crank wheel 4.

The crank wheel 4 is constructed as a toothed wheel in the embodiment shown. This crank wheel meshes with a drive wheel 10 that for its part is driven by a torque motor and thus puts the crank wheel 4 in rotation.

Moreover, the crank wheel 4 meshes with a compensation wheel 11 as a compensation shaft in the sense of the present application. The compensation wheel 11 serves to compensate free forces and moments of the first order on account of the oscillating motion of the roll stand 2 and to thus contribute to a quieter and more uniform course of the roll stand 2.

To this end the compensation wheel 11 comprises a counter-mass 12 that is eccentrically fastened on the compensation wheel 11. Since the crank wheel 4 and the compensation wheel 11 have the same diameter, a revolution of the crank wheel 4 also results in exactly one revolution of the compensation wheel 11 and of the counter-mass 12 fastened on it. Compared to the compensation mass 9 of the crank wheel 4, the counter-mass 12 of the compensation wheel 11 is arranged offset by approximately 180° relative to the direction of translation 3 of the roll stand 2. That is, the compensation mass 9 and the counter-mass 12 are located in opposing halves of the crank wheel 4 and of the compensation wheel 11 at the reversal points of the roll stand 2 (upon a change of direction).

It can be clearly recognized from FIG. 1 that the axis of rotation 13 of the crank wheel 4 and the axis of rotation 14 of the compensation wheel 11 lie in a plane 15 that is vertical to the direction of movement 3 of the roll stand 2, i.e., they are arranged vertically above one another. This makes possible a space-saving arrangement relative to the construction length of the rolling mill.

The rolls received in the roll stand 2 (not shown in FIG. 1) define the position of the central axis 16 of the tube to be rolled. It can be clearly gathered from the representation of FIG. 1 that on account of the arrangement of the axes of rotation 13, 14 of the crank wheel 4 and of the compensation wheel 11 above one another, the central axis 16 runs between these axes of rotation 13, 14.

The selected construction has two general advantages. On the one hand the closeness of the axis of rotation 13 of the crank wheel 4 to the central axis 16 of the tube allows a comparatively flat angle between the connecting rod 5 and the direction of translation 3 of the roll stand 2. This results in a more uniform course of the roll stand 2 and therefore in less wear on its guide elements. Given the simultaneous desire for a short construction length of the pilger rolling mill with the resulting consequence of the vertical arrangement of the axes of rotation 13, 14 above one another, there is either a solution at which the compensation wheel 11 is arranged deep below in a pit in the machine hall with all the associated difficulties, or, as is optimally solved in the embodiment presented, with an arrangement of the compensation wheel 11 vertically above the crank wheel 4.

Figure 2:
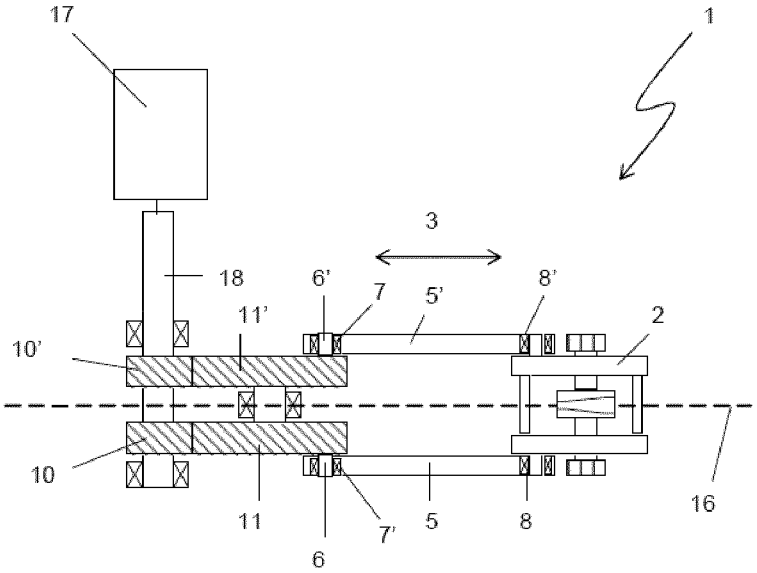
FIG. 2 shows a top view of the embodiment in FIG. 1.

Whereas the vertical arrangement of the wheels 4, 11 and their axes of rotation 13, 14 above one another, here the compensation wheel 11 above the crank wheel 4, can be clearly gathered from FIG. 1, FIG. 2 shows in a top view onto the pilger rolling mill 1 in FIG. 1 that the selected arrangement concerns an arrangement that is symmetrical to a plane vertical to the axes of rotation 13, 14 and through the central axis 16 of the tube to be rolled.

It is clear from FIG. 2 that the arrangement comprises two crank wheels 4, 4' (they are actually not shown in FIG. 2 since they are located in the shown view from above under the compensation wheels 11, 11' and covered by them) that drive two connecting rods 5, 5' via two crank pins 6. 6'. Furthermore, both two ends 8, 8' of the connecting rods 5, 5' are pivotably attached to the roll stand 2. Even the drive wheel 10, 10' is present twice and each one meshes with a crank wheel 4, 4'. The symmetric arrangement relative to a plane of symmetry through the central axis 16 of the tube to be rolled helps to compensate bending moments acting on the arrangement.

FIG. 2 also shows that the drive of the drive wheels 10, 10' is made available by an electric direct drive with a motor 17 that acts, without an intermediate transmission, via a coupling on the shaft 18 of the drive wheels 10, 10'.

Figure 3:
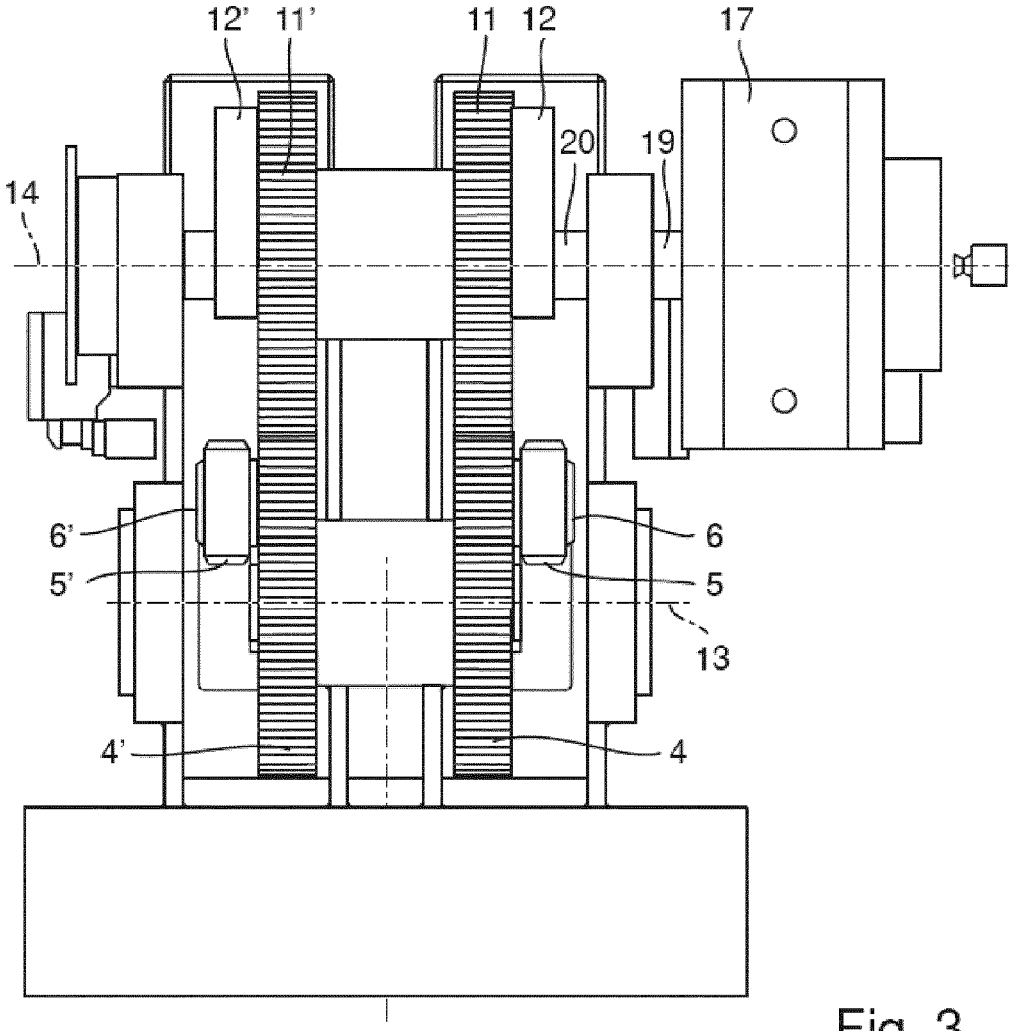
FIG. 3 shows a partially broken away schematic view from the front onto a crank drive with compensation shaft in another embodiment of the invention.

The embodiment of FIG. 3 differs from the embodiment of FIGS. 1 and 2 substantially in that the drive motor 17 here does not act first on the shaft of two drive wheels but rather that the hollow shaft of the motor 17 is pushed directly onto a projecting section 19 of the shaft 20 of the compensating wheels 11, 11' and is connected to it. In this manner the motor 17 directly drives the shaft 20 of the compensation wheels 11, 11'. The compensation wheels 11, 11' therefore replace the drive wheels 10, 10' of the embodiment in FIGS. 1 and 2. Since the compensation wheels 11, 11' are designed as previously as gears that mesh with the crank wheels 4, 4', the crank wheels are directly driven by the motor, i.e., without a step-up or step-down, since the compensation wheels 11, 11' as well as the crank wheels 4, 4' have the same diameter. The high torque required for this is made available by a so-called torque motor. Torque motor in the sense of the present application is in particular a high-polar, electrical direct drive from the group of slow-speed engines. Torque motors have very high torques at relatively low rotational speeds.

In addition, the representation of the embodiment in FIG. 3 allows a preferred symmetrical arrangement of the masses on the wheels 4, 4', 11, 11' to be clearly recognized. As shown, the compensation wheels 11, 11' as well as the crank wheels 4, 4' have a finite width. The crank pins 6, 6' on the crank wheels 4, 4' extend axially outward from the wheels, i.e., they are located outside of their width so that the connecting rods 5, 5' can pivot freely on the crank pins 6, 6'. The compensation masses 9, 9' (cannot be recognized in the view of FIG. 3) are located opposite them inside the width of the crank wheels 4, 4'. In other words, the crank pins and the first ends 7, 7' of the connecting rods 5, 5' received on them lie in a first plane vertical to the axes of rotation 13, 14 and the compensation masses 9, 9' lie in a second plane offset to the first plane in the axial direction.

The counter-masses 12, 12' of the compensation wheels 11, 11' are arranged oppositely in the same planes as the crank pins 6, 6' and the connecting rods 5, 5' fastened to them.

It is pointed out for purposes of the original disclosure that all features that result for a person skilled in the art from the present specification, the drawings and the claims, even if they were described concretely only in conjunction with certain other features, can be combined individually as well as in any combinations, in as far as this was not expressly excluded or technical features render such combinations impossible or meaningless. For the sake of brevity and the readability of the specification, a comprehensive, explicit presentation of all conceivable combinations of features is not made here.

Whereas the invention was presented and described in detail in the drawings and the preceding specification, this presentation and this description are only meant to be by way of example and not as a limitation of the protective scope as it is defined by the claims. The invention is not limited to the disclosed embodiments.

Modifications of the disclosed embodiments are obvious to the person skilled in the art from the drawings, the specification and the attached claims. In the claims the word "comprise" does not exclude other elements or steps and the indefinite article "a" does not exclude a plurality. The mere fact that certain features are claimed in different claims does not exclude their combination. Reference numerals in the claims are not meant to be a limitation of the protective scope.

LIST OF REFERENCE NUMERALS

1 pilger rolling mill
2 roll stand
3 direction of movement
4, 4' crank wheel
5, 5' connecting rod
6,6' crank pin
7,7' first end of the connecting rod
8,8' second end of the connecting rod
9,9' compensation mass
10, 10' drive wheel
11, 11' compensation wheel
12, 12' counter-mass
13 axis of rotation of the crank wheel
14 axis of rotation of the compensation wheel
15 plane
16 central axis of the tube to be rolled
17 motor
18 shaft of the drive wheels
19 drive shaft
20 shaft of the compensation wheels

The invention claimed is:

1. A pilger rolling mill with a roll stand linearly moveable back and forth along a movement direction, the pilger rolling mill comprising:

a crank mechanism including a crankshaft rotatably supported about an axis of rotation, the crankshaft having a crank pin spaced at a radial distance from the axis of rotation, wherein the crankshaft is a crank wheel, the crank pin being spaced on the crank wheel at a radial distance from the axis of rotation of the crankshaft, the crank wheel having a width in a direction parallel to the axis of rotation of the crankshaft, wherein a compensation mass is arranged inside the width of the crank wheel;

a push rod having a first end and a second end, whereby the first end of the push rod is pivotably fastened to the crank pin, and whereby the second end of the push rod is pivotably fastened to the roll stand, such that during operation of the pilger rolling mill a rotary movement of the crankshaft is converted into a linearly oscillating movement of the roll stand; and a compensation shaft rotatably supported about an axis of, the compensation shaft including a distribution of mass that is not rotationally symmetrical relative to its axis of rotation and a counter-mass, whereby the crankshaft and the compensation shaft are connected to one another by a transmission so that a rotation of the crankshaft leads to a rotation of the compensation shaft, the axis of rotation of the crankshaft and the axis of rotation of the compensation shaft being spaced at a distance from each other in a direction vertical to the direction of movement of the roll stand.

2. The pilger rolling mill according to claim 1, wherein the axis of rotation of the crankshaft and the axis of rotation of the compensation shaft lie in a plane vertical to the direction of movement of the roll stand.

3. The pilger rolling mill according to claim 1, wherein the axis of rotation of the crankshaft is arranged in a direction vertical to the direction of movement of the roll stand under the axis of rotation of the compensation shaft.

4. The pilger rolling mill according to claim 1, wherein the roll stand includes two rolls, whereby the rolls fix a central pipe axis of a pipe to be rolled, whereby the axis of rotation of the crankshaft is arranged underneath the central pipe axis and the axis of rotation of the compensation shaft is arranged above the central pipe axis.

5. The pilger rolling mill according to claim 1, the compensation mass and the crank pin with the push rod are arranged at a distance from each other in the direction of the axis of rotation.

6. The pilger rolling mill according to claim 1, wherein the compensation shaft is a compensation wheel that has a width in the direction of the axis of rotation of the compensation shaft, whereby the counter-mass is arranged at least in sections outside of the width of the compensation wheel.

7. The pilger rolling mill according to claim 6, wherein the crank wheel and the compensation wheel are tooth wheels that mesh with one another and form the transmission connecting the crankshaft and the compensation shaft to one another.

8. The pilger rolling mill according to claim 1, wherein the crank mechanism includes two crank pins rotatable about a common axis of rotation and distanced radially from the common axis of rotation and two push rods, each having a first and a second end, whereby the first end of each push rod is pivotably fastened on a crank pin and whereby the second end of each push rod is pivotably fastened on the roll stand so that during the operation of the pilger rolling mill a rotary motion of the crankshaft is converted into a linearly oscillating movement of the roll stand, and whereby the compensation shaft includes two compensation masses that can rotate about the same axis of rotation.

9. The pilger rolling mill according to claim 1, further comprising a drive motor with a motor shaft, whereby the motor shaft is directly connected to the crankshaft or to the compensation shaft such that a rotation of the motor shaft results in exactly one rotation of the crankshaft or of the compensation shaft.

10. The pilger rolling mill according to claim 1, further comprising a drive motor arranged to drive the compensation shaft and via the latter drives the crankshaft.

* * * * *